United States Patent [19]

Gwozdz

[11] 4,050,115

[45] Sept. 27, 1977

[54] DOOR HINGE

[75] Inventor: Joseph W. Gwozdz, Clark Summit, Pa.

[73] Assignee: McKinney Manufacturing Company, Scranton, Pa.

[21] Appl. No.: 732,353

[22] Filed: Oct. 14, 1976

[51] Int. Cl.[2] ..... E05D 9/00; E05D 15/00

[52] U.S. Cl. ..... 16/128 R; 16/189

[58] Field of Search ..... 16/75, 50, 136, 128, 16/129, 135, 171, 115, 176, 139, 147, 178, 168, 133, 134, 189

[56] References Cited

U.S. PATENT DOCUMENTS

| | | | |
|---|---|---|---|
| 1,772,560 | 8/1930 | Soss | 16/128 R |
| 2,120,684 | 6/1938 | Soss | 16/128.1 |
| 3,423,787 | 1/1969 | Horstman | 16/178 |

*Primary Examiner*—Ronald Feldbaum

*Attorney, Agent, or Firm*—Brown, Murray, Flick & Peckham

[57] ABSTRACT

One of a pair of hinge leaves has an integral open outer loop extending along one edge and the other leaf has an integral inner loop extending along one edge and disposed inside the outer loop. The inner loop is mounted on a hinge pin extending through it and provided with longitudinally spaced exposed areas encircled and engaged by spacing members rigidly mounted in the outer loop to hold the pin in predetermined position in that loop. The opposed surfaces of the two loops are held apart by the pin and spacing members to prevent the loops from rubbing together when the hinge is opened and closed. By making the hinge pin hollow and extending a torsion rod through it, with one end of the rod attached to the inner loop and the opposite end connected to the outer loop, the rod will be twisted when the hinge is opened and will close the hinge when it is released.

10 Claims, 11 Drawing Figures

DOOR HINGE

In U.S. Pat. No. 3,423,787 a hinge is disclosed, in which the two leaves are provided along one edge with inner and outer loops nested together. The outer loop is provided with an integral hinge pin, around which the inner loop turns. The inner loop not only slides against the hinge pin when the hinge is opened or closed, but the opposed curved surfaces of the two loops slide against each other. This rubbing together of these curved surfaces can cause them to be scratched or marred, thereby detracting from the appearance of the hinge and creating a condition that may cause the hinge to bind.

It is an object of this invention to provide a hinge of the general type shown in the patent just mentioned, but in which the inner and outer loops do not rub against each other when the hinge is opened and closed. Another object is to provide such a hinge with a concealed torsion spring for urging the hinge into closed position, and with means for adjusting the tension on the spring.

The invention as illustrated in the accompanying drawings, in which

Figure 1:
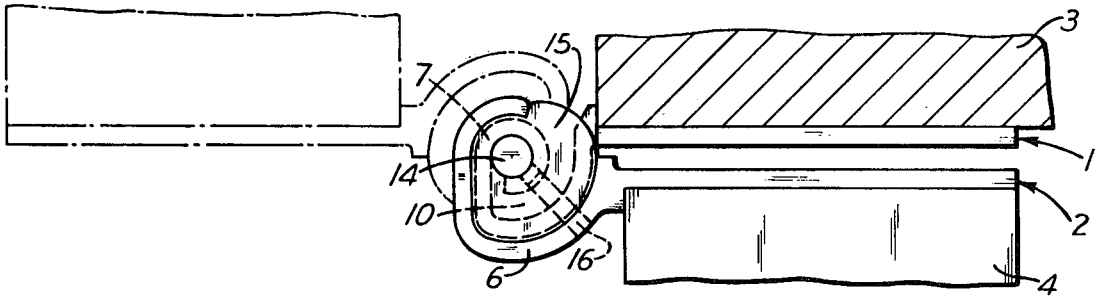
FIG. 1 is a plan view of the closed hinge fastened to a door and door jamb.
Figure 2:
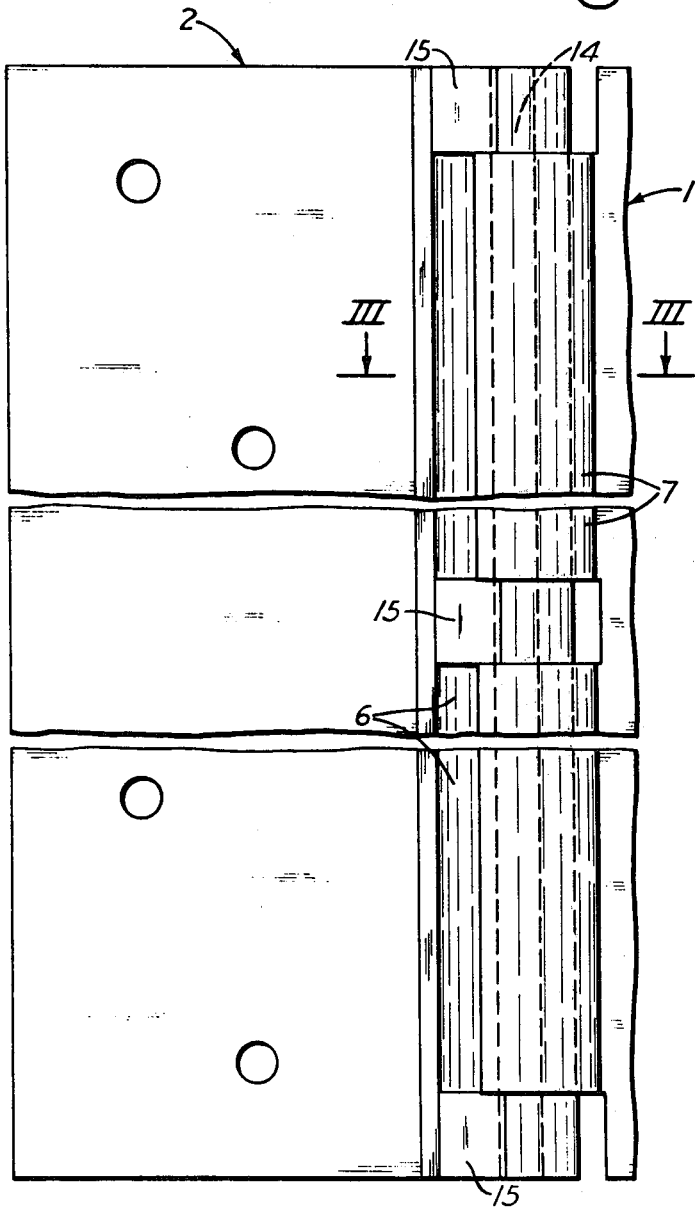
FIG. 2 is a side view of the open hinge, with part of it broken away.
Figure 3:
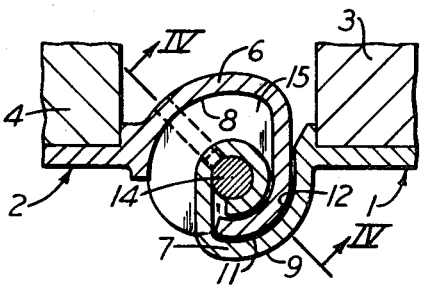
FIG. 3 is a fragmentary section taken on the line III—III of FIG. 2.
Figure 4:
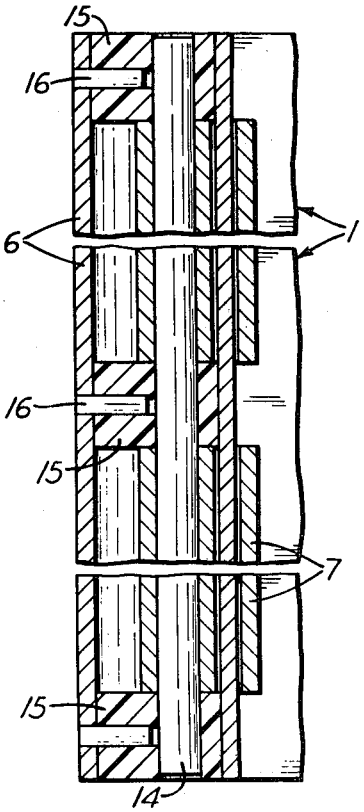
FIG. 4 is a vertical section taken on the line IV—IV of FIG. 3.

Referring to FIGS. 1 to 4 of the drawings, a pair of hinge leaves 1 and 2 are disposed in substantially parallel relation close together, with one secured to a door jamb 3 and the other fastened to a door 4. Preferably, leaf 1 is fastened to the jamb. These leaves, and consequently the hinge as a whole, may be any length desired. Thus, the hinge may be a butt hinge only a few inches long, in which case two or more vertically spaced hinges would be used on a door, or the hinge may be as long as the door so that only one continuous hinge is required.

The hinge leaves project a short distance from one side of the door. Integrally joined to their projecting edges is a pair of loops that extend along the leaves. Each leaf and its loop may be extruded as a single piece. The loop 6 projecting from the leaf that is attached to the door is an open loop; that is, its outer or free edge is spaced a considerable distance from its inner edge that is joined to the leaf 2. Disposed inside of this outer loop is the other or inner loop 7, which is curled on itself with its outer or free edge close to the rest of the loop to form a cylindrical passage extending lengthwise through the loop. While the door is closed, the two loops have opposed curved surfaces 8 and 9, and the outer loop is shaped so that, when the door is opened, a portion of the outer loop will swing into an arcuate channel 10 in the inner loop. At that time there are opposed curved surfaces 11 and 12.

Extending through the cylindrical passage in the inner loop 7 is a hinge pin 14, on which the inner loop is mounted. This pin has longitudinally spaced exposed areas, meaning areas that are not encircled by the inner loop. Thus, the ends of the pin may project from the ends of the inner loop and, if it is a long hinge, the loop may be cut away at one or more intermediate locations to expose the pin. The exposed areas of the pin are encircled and tightly engaged by spacing members rigidly mounted in the outer loop. These spacing members, through which the hinge pin extends, also serve as anti-friction thrust bearings to prevent longitudinal movement of the loops relative to each other. For example, each spacing or bearing member may be a block 15 of a suitable hard plastic, such a Teflon, which is held in place in the outer loop by a dowel pin 16 (FIG. 4) rigidly mounted in the loop and extending into an opening in the bearing block. The inner loop is shorter than the outer loop to provide space in the ends of the outer loop for the end blocks.

It will be seen that the bearing blocks, which are mounted on the hinge pin, hold the outer loop in a predetermined position relative to the inner loop. The chosen position is one in which the two loops are spaced from each other by the hinge pin and bearing blocks so that the loops will not rub against each other when the hinge is opened and closed. This spacing of the loops prevents the opposed surfaces 8 and 9 or 11 and 12 of the two loops from being marred during movement of the hinge. The spacing of the two loops also eliminates any necessity for accurately fitting engaging surfaces together, as is the case with the hinge shown in U.S. Pat. No. 3,423,787, and avoids any possibility of the loops binding against each other.

Figure 5:
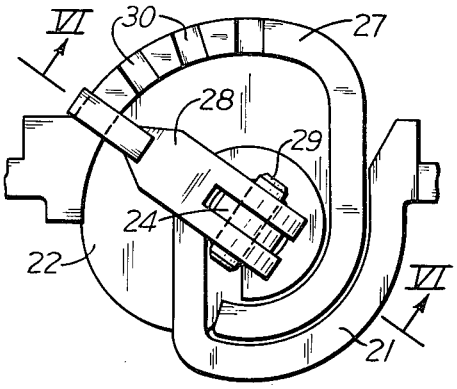
FIG. 5 is a fragmentary plan view of a modified hinge.
Figure 6:
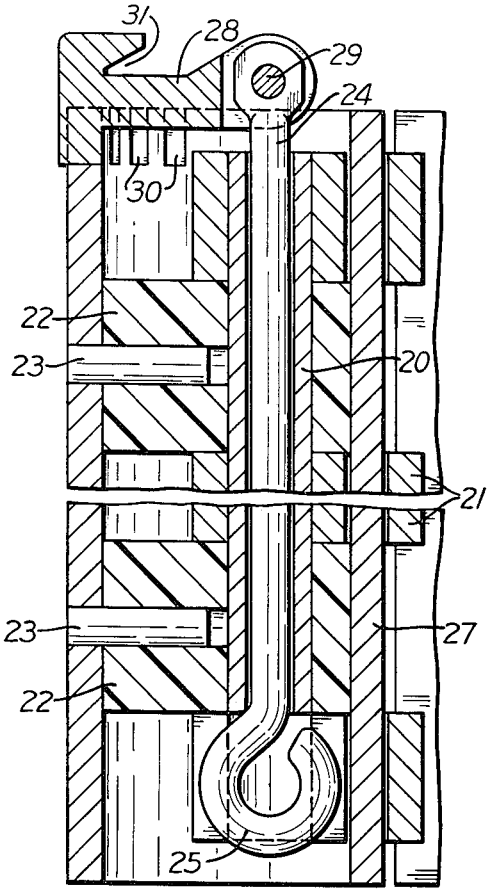
FIG. 6 is a vertical section taken on the line VI—VI of FIG. 5.

In the modification shown in FIGS. 5 and 6, the hinge pin 20 is hollow and at least one end of it is spaced inwardly from the corresponding end of the inner loop 21 of the hinge mounted on the pin. Portions of the inner loop are cut away to receive thrust-bearings 22 that tightly encircle the hinge pin and that are rigidly connected to the outer loop by dowel pins 23. Extending through the hollow hinge pin is a torsion rod 24, one end of which, preferably the lower end, projects from the pin and is rigidly disposed in the lower end of the inner loop. This can be done by forming a laterally projecting portion or head 25 on the lower end of the rod and inserting it in a vertical slot in the inner loop. The slot can be a special one or it can be the result of not having the free edge of the inner loop engage the opposed portion of the loop.

The upper end of the torsion rod projects from the upper ends of the hinge pin and inner loop 21 and is rigidly connected with the outer loop 27 of the hinge so that when the door, to which the hinge is fastened, is opened, the rod will be twisted on its longitudinal axis and will close the door when the door is released. There are various ways of rigidly connecting the upper end of the rod with the outer loop. One way is to flatten the upper end of the rod as shown in FIGS. 5 and 6, and insert it in the forked inner end of a horizontal latch 28, with a pivot pin 29 extending through the rod and latch. The outer end of the latch extends down into any one of several notches 30 formed in the top of the outer loop. By lifting the outer end of the latch out of a notch and swinging it clockwise in FIG. 5 to twist the torsion rod and then inserting the latch in another notch, the rod can be pretensioned to increase the force it will exert in closing the door. The outer end of the latch may be provided with a notch 31 to receive a tool for lifting the latch so that it can be turned.

Figure 7:
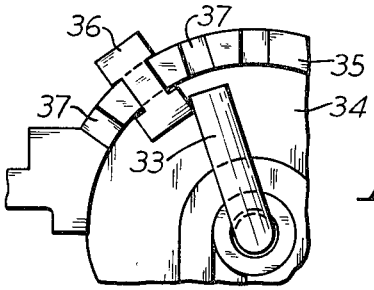
FIGS. 7, 8 and 9 are fragmentary plan views of three more modifications.

Another way to hold the upper end of a torsion rod 33 shown in FIG. 7 and adjust the tension on it is to extend it through a plug 34 rigidly mounted in the upper end of the outer loop 35 of the hinge and bend the upper end of the rod at right angles. The free end of the rod engages one side of a removable stop 36 inserted in any of several notches 37 in the top of the outer loop of the hinge.

Figure 8:
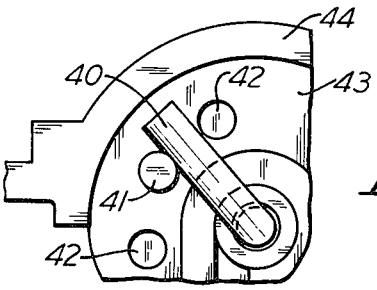

In a further embodiment shown in FIG. 8, the free end of the bent upper end of the torsion rod 40 engages a vertical pin 41 inserted in any one of several holes 42 in a plug 43 mounted in the upper end of the outer hinge loop 44. The pin 41 holds the upper end of the rod when the hinge is opened and also adjusts the tension on the rod.

Figure 9:
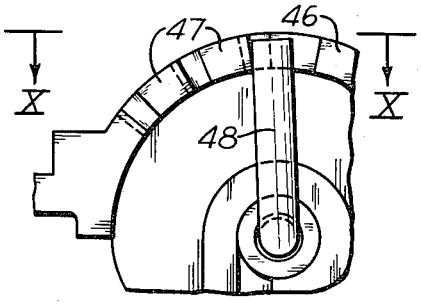
Figure 10:
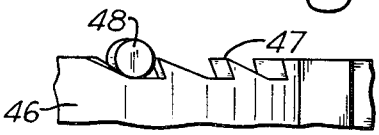
FIG. 10 is a side view taken on the line X—X of FIG. 9.

In the embodiment shown in FIGS. 9 and 10 the upper end of the outer loop 46 of the hinge is provided with ratchet teeth 47 that receive the bent-over upper end of the torsion rod 48 to hold it and to provide the desired pretension on the rod.

Figure 11:
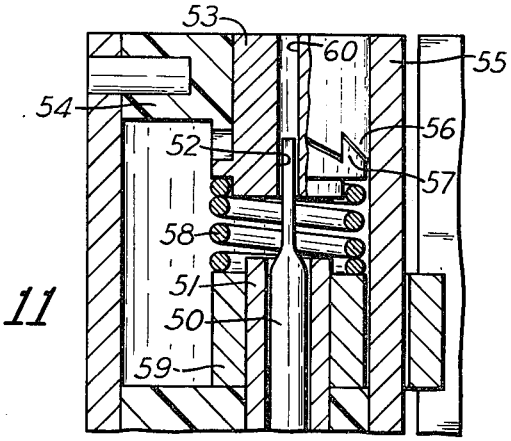
FIG. 11 is a fragmentary vertical section of still further modification.

A still further arrangement, as shown in FIG. 11, involves flattening the upper end of a torsion rod 50 and extending it up above the hollow hinge pin 51 and into a narrow slot 52 in a cylindrical plug 53 rotatably mounted in a stationary plug 54 secured in the uper end of the outer loop 55 of the hinge. The bottom of plug 54 is provided with teeth 56 that engage with teeth 57 on the underlying portion of the plug 53. The two sets of teeth normally are held in engagement with each other by a coil spring 58 compressed between plug 53 and the upper end of the inner loop 59 of the hinge. The top of plug 53 is provided with a screw driver slot 60, or similar opening, so that the plug can be turned to increase the tension on the torsion rod.

In all of these embodiments of this invention, if the hinge pins are rigidly mounted in the inner loops of the hinges, the thrust bearing blocks will also serve as sleeve bearings for the pins, so all moving metal surfaces will engage only antifriction material. On the other hand, if the hinge pins are rigidly mounted in the thrust bearing blocks, the inner loops of the hinges will turn on the pins, but since the engaging metal surfaces are not visible, any scratching of those surfaces will not be noticed.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A door hinge comprising a pair of parallel hinge leaves adapted to be fastened to a door and a door jamb, an integral open outer loop extending along one edge of one of the leaves, and integral inner loop extending along one edge of the other leaf and disposed inside said outer loop, a hinge pin extending through said inner loop in engagement therewith and having longitudinally spaced exposed areas, and spacing members rigidly mounted in said outer loop and encircling said exposed areas of the hinge pin in engagement therewith to hold the pin in predetermined position in the outer loop, and the opposed surfaces of the two loops being held apart by said pin and spacing members to prevent the loops from rubbing together when the hinge is opened and closed.

2. A door hinge according to claim 1, in which said outer loops extends beyond the ends of the inner loop, the ends of the hinge pin project from the ends of the inner loop, said spacing members are thrust bearings disposed in the ends of the outer loop in engagement with the adjoining ends of the inner loop, and said bearings are provided with openings snugly receiving the projecting ends of the pin.

3. A door hinge according to claim 1, in which said pin is hollow, the hinge including a torsion rod extending through the pin and projecting from its opposite ends with one projecting end of the rod rigidly connected with one end of the inner loop, the opposite end of the rod projecting from the opposite end of the inner loop, means holding said opposite end of the rod stationary relative to said outer loop, whereby when the hinge is opened the rod will be twisted.

4. A door hinge according to claim 3, in which said inner loop is provided with a longitudinal slot, and said one projecting end of the rod is provided with a laterally projecting portion extending into said slot.

5. A door hinge according to claim 3, said holding means beng adjustable circumferentially of said hinge pin to vary the initial tension on said rod.

6. A door hinge according to claim 3, in which said holding means include a plurality of recesses in the end of the outer loop beside said opposite end of the rod, a latch, and means pivoting one end of the latch to the adjoining end of said rod on a transverse axis, the opposite end of the latch being removably disposed in one of said recesses.

7. A door hinge according to claim 3, in which said outer loop extends beyond the ends of the inner loop, said spacing members include thrust bearings disposed in the ends of the outer loop in engagement with the adjoining ends of the inner loop, and one end of said rod extends through one of said bearings and is bent laterally across it, said holding means including a pin projecting from said one bearing and engaging one side of the laterally bent end of the rod.

8. A door hinge according to claim 3, in which one end of the outer loop extends beyond the adjoining end of the inner loop, the hinge including a first plug rigidly mounted in said end of the outer loop and spaced from the adjacent end of the inner loop, the plug being provided with an opening through it aligned with the hinge pin, said holding means including a second plug slidably and rotatably mounted in said opening and provided at its inner end with a slot, the adjacent end of said rod being flat and disposed in said slot, the inner end of the second plug overlapping the inner end of said first plug, the overlapping surfaces of said plugs being provided with interengaging teeth, and a spring compressed between the inner end of the second plug and the adjacent end of the inner loop for normally holding said teeth in engagement with one another, the outer end of the second plug being formed for manual turning to twist said rod in order to pretension it.

9. A door hinge according to claim 3, in which said holding means include notches in the end of the outer loop beside said opposite end of the rod, and a removable stop disposed in any one of said notches, one end of said rod being bent laterally into engagement with one side of said stop.

10. A door hinge according to claim 3, in which said outer loop extends beyond the ends of the inner loop, one of said spacing members being disposed in one end of the outer loop and provided with holes spaced around said rod, said holding means including a pin removably disposed in any one of said holes, and the adjacent end of the rod being bent laterally into engagement with one side of said pin.

* * * * *